US005390909A

United States Patent [19]

Herrick, Jr.

[11] Patent Number: 5,390,909

[45] Date of Patent: * Feb. 21, 1995

[54] SHEET JUSTIFIER

[75] Inventor: Robert F. Herrick, Jr., Deep River, Conn.

[73] Assignee: Roll Systems Inc., Burlington, Mass.

[ * ] Notice: The portion of the term of this patent subsequent to Jan. 25, 2011 has been disclaimed.

[21] Appl. No.: 177,730

[22] Filed: Jan. 5, 1994

Related U.S. Application Data

[63] Continuation of Ser. No. 939,064, Sep. 2, 1992, Pat. No. 5,280,903.

[51] Int. Cl.[6] ..... B65H 9/16

[52] U.S. Cl. ..... 271/251; 271/248

[58] Field of Search ..... 271/248, 249, 250, 251

[56] References Cited

U.S. PATENT DOCUMENTS

| | | | |
|---|---|---|---|
| 1,061,979 | 5/1913 | Burton | 271/253 X |
| 2,190,413 | 2/1940 | Davidson | 271/251 |
| 4,640,504 | 2/1984 | Garavuso et al. | 271/264 X |
| 4,674,375 | 6/1987 | Golicz | 271/314 |
| 5,280,903 | 1/1994 | Herrick, Jr. | 271/251 |

FOREIGN PATENT DOCUMENTS

| | | | |
|---|---|---|---|
| 376554 | 7/1932 | United Kingdom | 271/250 |
| 2175573 | 12/1986 | United Kingdom | 271/248 |

*Primary Examiner*—H. Grant Skaggs
*Assistant Examiner*—Carol Lynn Druzbick
*Attorney, Agent, or Firm*—Wolf, Greenfield & Sacks

[57] ABSTRACT

A sheet justifier provides a table having at least one rotational surface thereon that is substantially aligned with the table. A sheet is input to the table into contact with the rotational surface. A weighted ball is positioned over the rotating surface proximate an outer edge of the rotating surface. The sheet is grasped between the ball and the rotating surface and forced against a raised guide edge. Once the sheet is forced against the guide edge, all rotational driving force is translated in a downstream direction therealong so that the sheet is driven out of the guide edge with its edge aligned therewith in a justified orientation.

13 Claims, 6 Drawing Sheets

SHEET JUSTIFIER

This application is a continuation of application Ser. No. 07/939,064, filed on Sep. 2, 1992, now U.S. Pat. No. 5,280,903.

FIELD OF THE INVENTION

The present invention relates to a device for justifying the edges of input sheets regardless of their orientation when input.

BACKGROUND OF THE INVENTION

It is often desirable to transfer sheets of, for example, paper between two devices, such as a printer and a further utilization device (e.g. a folder) without the need of a complex conveyor system. In general, such a conveyor system is necessary to prevent misalignment of sheet edges as they pass from one device to another. Misalignment of sheets can cause jams or otherwise lower the quality of the finished product.

Many printers and other sheet handling devices include ports from which sheets are output in serial order. Absent a complex coupling from the port to a further utilization device, these ports cannot be relied upon to output sheets in an aligned and justified manner.

In addition, sheets are often fed to a common path from a pair of slit and merged web. In this instance, sheet justification is highly desirable.

A user may also desire manual input of sheets to a device. A justifier can guarantee aligned feeding even when sheets are input rapidly by the user's hand.

It is therefore an object of this invention to provide a sheet justifier that can receive misaligned sheets from a port or other source, such as manual input, and aligned the edges of the sheets in a uniform justified manner. It is a further object of this invention to provide a sheet justifier that can be adapted to receive sheets from a variety of sources and that can be adapted to output sheets to a variety of utilization devices. It is yet another object of this invention to provide a sheet justifier that operates with increased reliability.

SUMMARY OF THE INVENTION

A sheet justifier according to this invention provides a supporting surface in the form a table having opposing ends for receiving sheets from an upstream port and outputting sheets to a downstream utilization device. A raised edge guide is provided along a substantial portion of one edge of the table, running along a sheet flow direction from upstream to downstream. A rotating surface, typically a disk, is provided adjacent the edge guide and substantially coplanar with the table surface. Near the outer edge of the disk, slightly upstream and adjacent the edge guide is provided a freely rotating mass such as a ball that is stationary relative to the disk but rotates in place in response to and following the rotation of the disk. An input sheet passing downstream between the ball and the disk is forced by the component of force perpendicular to the flow direction against the edge guide. The downstream component of force generated by disk rotation simultaneously forces the sheet to move downstream. The perpendicular component maintains the sheet against the edge and, thus, causes it to be output in a parallel justified orientation.

A plurality of rotating surfaces and balls can be aligned along the table to insure full justification of the sheet. The raised edge can be movable, as can the other justifier components, to produce jog offset sheets at selected times.

Additionally, a second freely rotating mass, such as a ball, can be provided between the axis of rotation and the more outwardly disposed ball in order to enable rotation of sheets so that each of their sides engage the raised edge guide. The second more inwardly disposed ball can be selectively applied to sheets to allow rotation of the sheet through a desired number of edges so that a desired orientation is obtained.

BRIEF DESCRIPTION OF THE DRAWINGS

The foregoing objects and other advantages of the invention will become more clear with reference to the following detailed description of the preferred embodiments as illustrated by the drawings in which.

DETAILED DESCRIPTION

Figure 1:
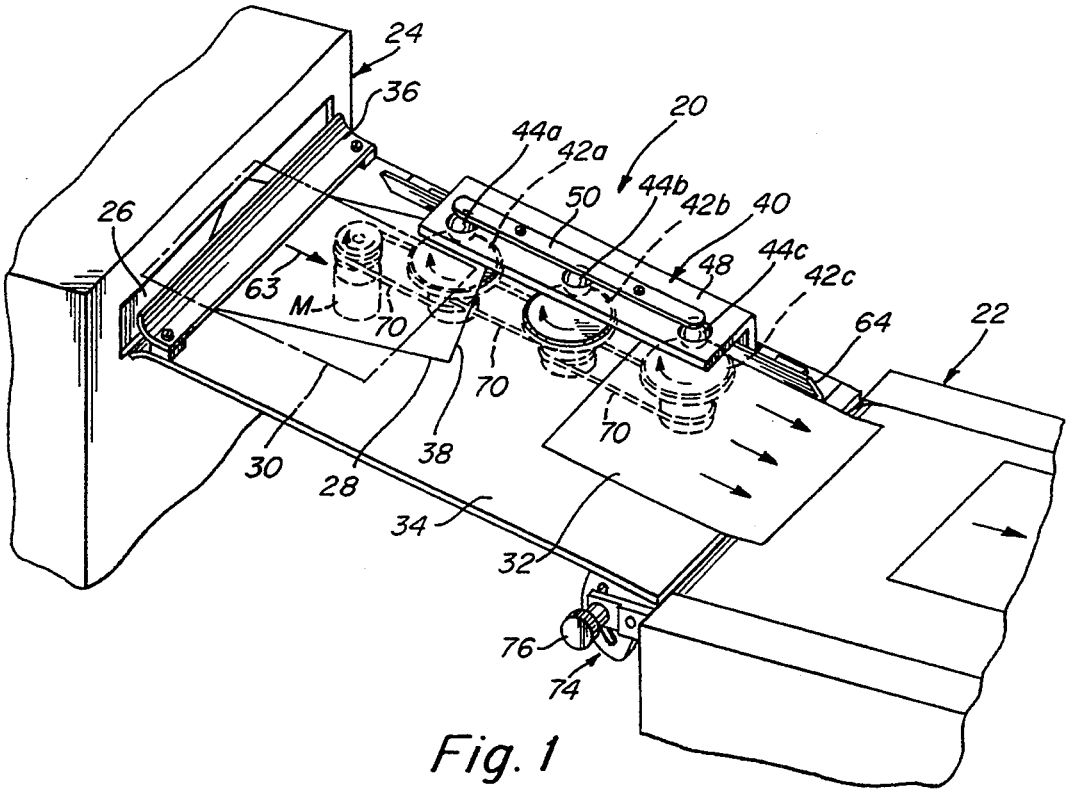
FIG. 1 is a perspective view of a sheet justifier according to a preferred embodiment.
Figure 2:
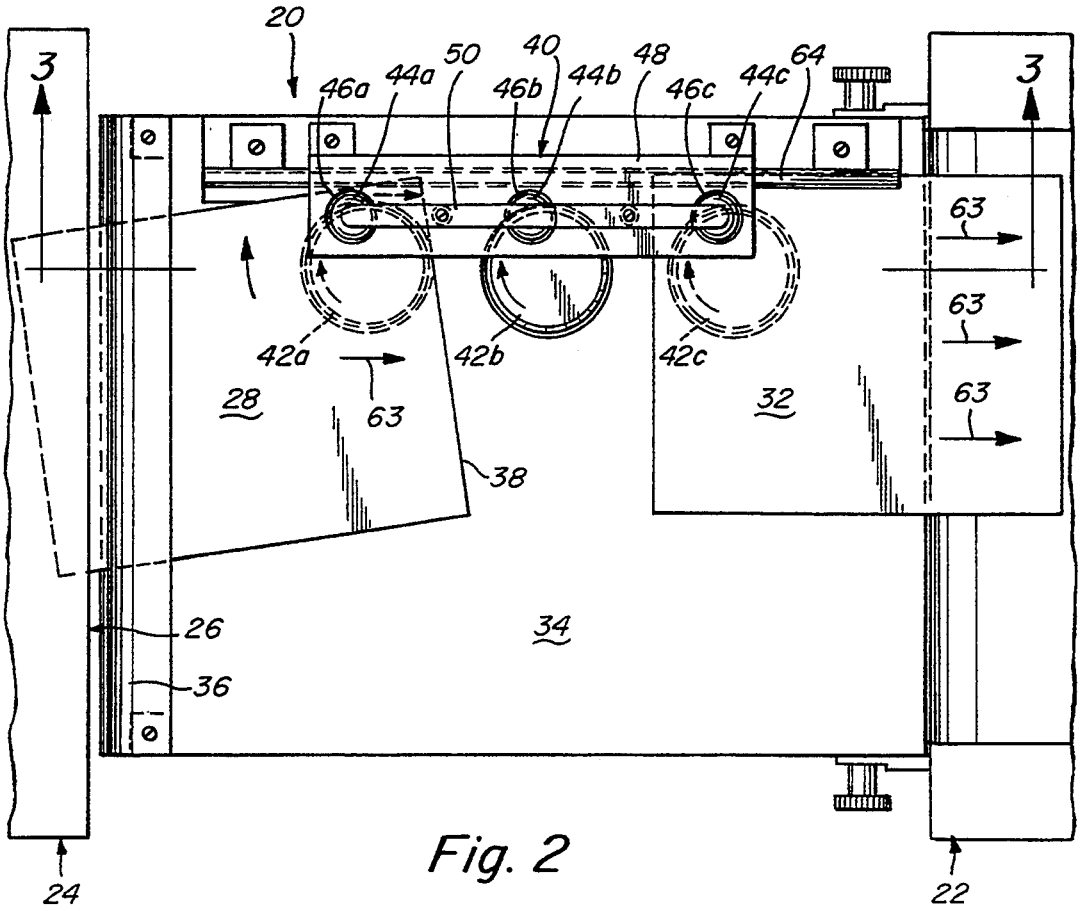
FIG. 2 is an exposed top view of the sheet justifier of FIG. 1.
Figure 3:
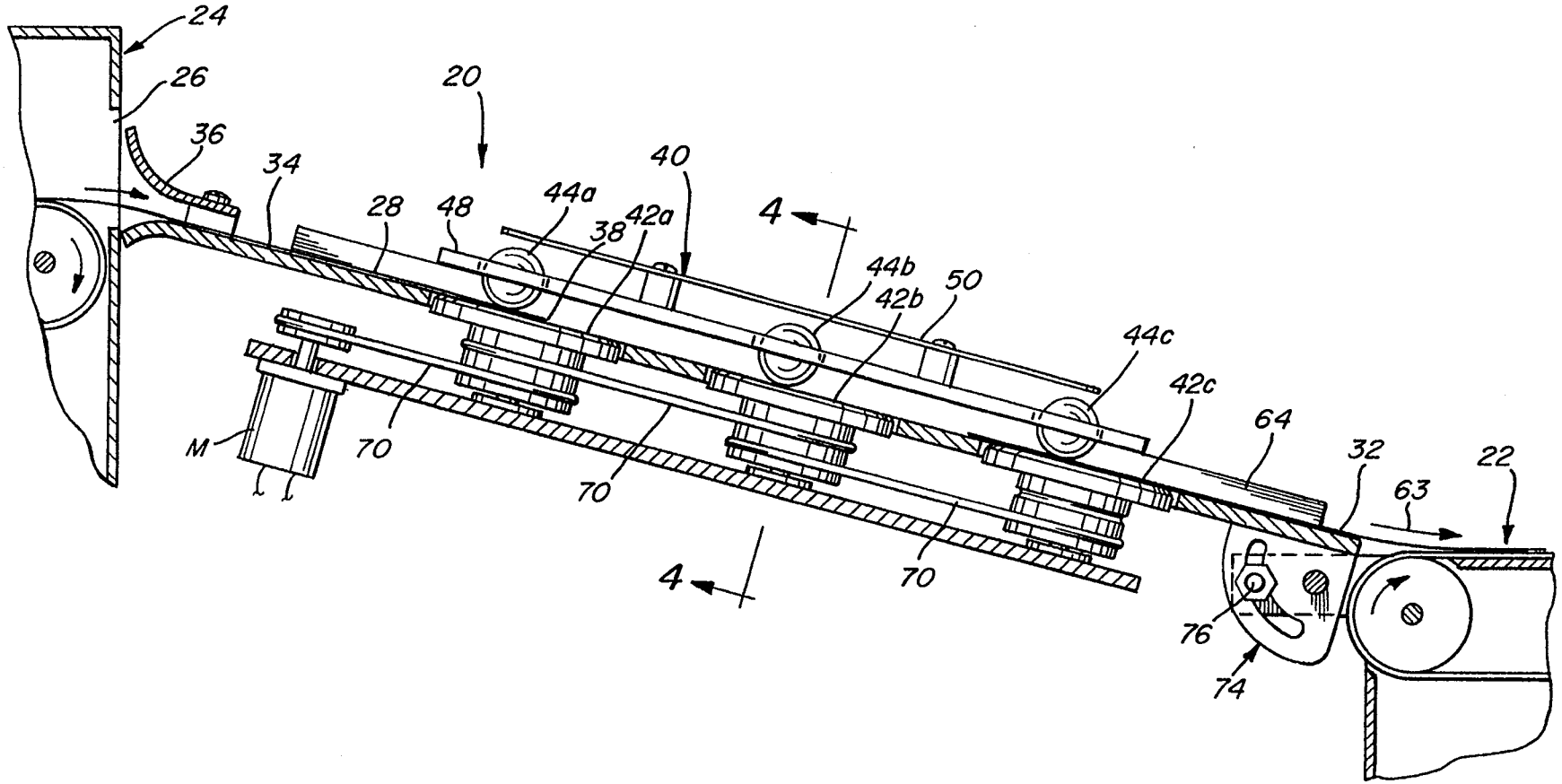
FIG. 3 is a cross-sectional side view of the sheet justifier taken along the line 3—3 of FIG. 2.
Figure 4:
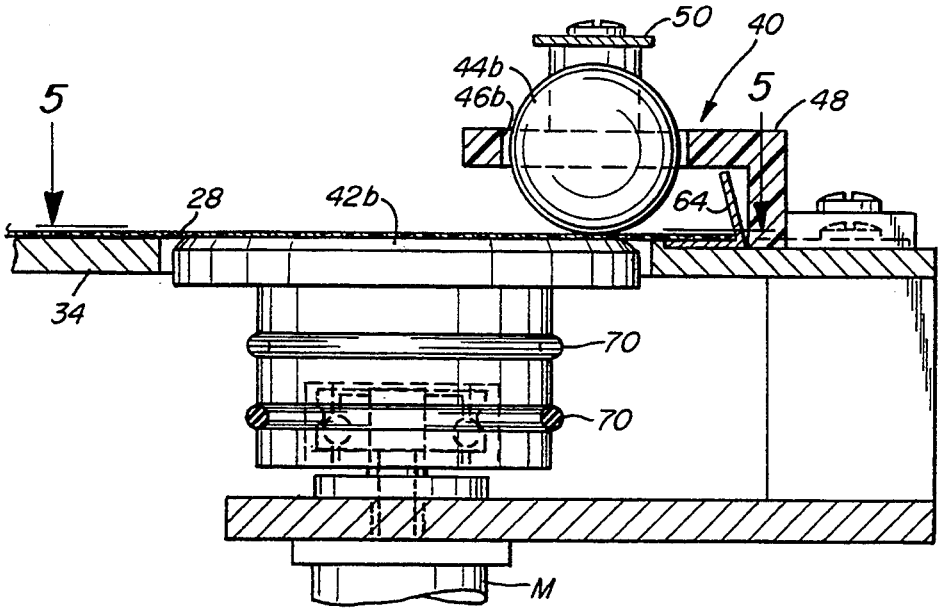
FIG. 4 is a partial cross-sectional rear view of the sheet justifier viewed in an upstream direction detailing the rotating disk and ball structure.

FIGS. 1–4 detail a sheet justifier 20 according to this invention. The sheet justifier 20 is mounted on a utilization device 22 positioned downstream of another device 24 such as a printer having a port 26 that ejects sheets therefrom in a serial manner. As noted above, it is normally desirable to accurately register a sheet leaving a port and entering a utilization device 22. In this example, a sheet 28 has been output from the upstream port 26 in a somewhat crooked orientation (note the justified orientation of the sheet 30 shown in phantom). Without the use of a sheet justifier, the crooked sheet 28 would most likely jam or otherwise cause a defective output at the utilization device 22. The sheet justifier 20 in this embodiment straightens the sheet 28 so that it enters the utilization device 22 in a proper parallel orientation as exemplified by the downstream sheet 32.

The justifier 20 comprises a feeding table 34 constructed, for example, of sheet metal and defining a substantially flat surface over which sheets can pass. The table 34 has a funnel structure 36 at its upstream end. The funnel structure 36 helps to insure that the sheet leading edge 38 is guided onto the table surface of the justifier 20 as it exits the port. The crooked sheet 28 is driven out of the port under the driving power of the upstream device 24 approximately until it reaches the justifier mechanism 40. At such a time, the leading edge 38 of the sheet 28 is engaged by the justifier mechanism 40 and the sheet is moved into justified registration.

The justifier mechanism 40 according to this embodiment comprises three rotating disks 42*a–c* that have surfaces positioned approximately on level with the justifier table 34 through holes 44*a–c* provided in the table surface. While circular disks 42*a–c* are employed in this example, a variety of geometric shapes can be utilized and are contemplated according to this invention. Each disk 42*a–c* includes at a position over its surface a weighted ball 44*a–c* that comprises, in this example, a three-quarter inch diameter ball bearing that bears against the rotating disk surface. It is between the ball bearing and the disk that the leading edge of the sheets are grasped by the mechanism and it is by means of the positional interrelationship between the weighted ball bearing and the disk that the sheets are brought into registered alignment. While a ball bearing is used according to this embodiment, it should be understood that "ball" as used herein shall refer to any structure that rotates freely and/or can resolve rotation into two or more degrees of freedom to follow the movement of a sheet thereunder, such as a roller on gimbles (not shown).

Each ball bearing 44*a–c* is, itself, mounted within a corresponding hole 46*a–c* in a framework 48 that allows the balls 44*a–c* to rotate in all degrees of freedom. A bar 50 can be provided on the framework 48 above the ball bearings 44*a–c* to prevent them from popping out of their holes 46*a–c* in the framework 48. Space should be provided between the ball 50 and the top of each ball bearing 44*a–c* so that a large variation in thicknesses of sheets can be accommodated by the justifier mechanism 40 without causing the ball bearing tops to rub against the bar 50.

Figure 5:
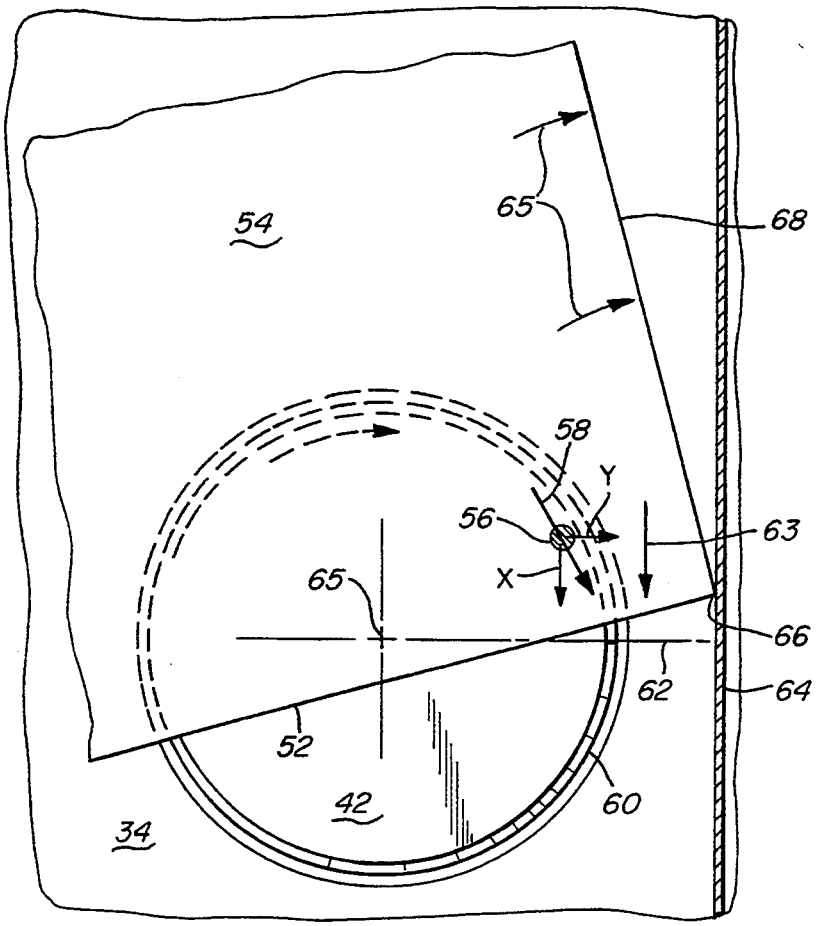
FIG. 5 is a somewhat schematic top view illustrating the justification of a sheet by a rotating disk and ball according to this invention.

Referring now to FIG. 5, it illustrates the principle governing the justification of sheets according to this invention. When the leading edge 52 of a sheet 54 is grasped between the ball bearing 44 and the moving surface of disk 42, the friction of the disk surface proximate the contact point 56 of the ball bearing 44 causes an immediate tangential movement of this sheet 54 relative to the disk 42 as shown by the arrow 58. The ball bearing (not shown) serves to concentrate the grip of the sheet 54 by the disk 42 at the contact point 56 while the remaining disk surface slides relative to the sheet. Thus, the sheet 54 is driven by the localized movement of the disk 42 at the contact point 56. The contact point 56 of the ball bearing 44 in this embodiment should be placed near the outer edge 60 of the disk 42 and upstream of a line 62 taken through the center axis 65 of the disk and perpendicular to the direction of the sheet flow shown by the arrow 63. In this embodiment, a $2\frac{1}{2}$ to 3 inch disk can be utilized in which the contact point is positioned $\frac{1}{2}$ to 1 inch upstream of the diameter line 62.

The sheet justifier 20 according to the embodiment of FIGS. 1–4 and as shown in FIG. 5 includes a raised vertical edge guide 64 running almost the full length of the table 34. The edge guide 64 is parallel to the direction of sheet flow (arrow 63). The edge guide 64 slants inwardly toward the sheets in this embodiment to maintain the edges of sheets moving therealong firmly against the table surface. As shown in FIG. 5, the raised edge guide is a block that prevents the corner 66 of the sheet 54 from moving further along the tangent (arrow 58) direction of disk rotation. As such, as the disk continues to rotate, the sheet is, itself, caused to rotate (arrows 65) inwardly toward the raised edge guide 64. This is because the sheet is driven almost entirely at the contact point of the ball bearing. The rotationally generated tangential force of the disk can be resolved into perpendicular force vectors X and Y emanating from the contact point as shown. The force vector Y perpendicular to the edge guide 64 causes the sheet to move its side edge 68 into contact with the raised edge guide 64. Simultaneously, the force vector X causes sheet motion along the flow direction (arrow 63). Since sheet movement generated by the force vector Y is blocked by the edge guide 64 once the sheet edge 68 has moved fully into contact with the edge guide 64, only the downstream directed vector X can act upon the sheet once it has rotated against the edge guide 64.

Figure 6:
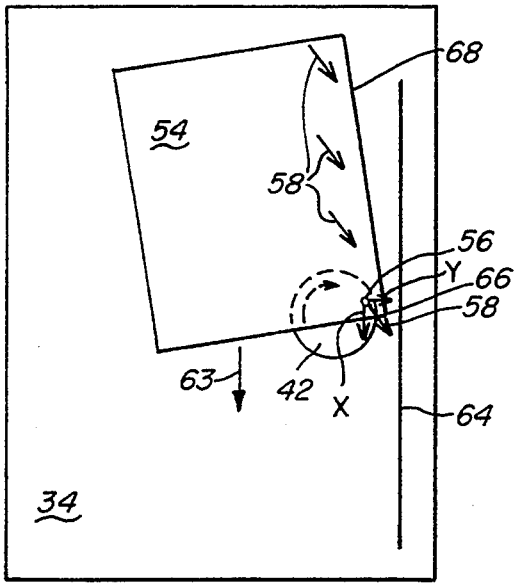
FIGS. 6–9 are somewhat schematic top views of a justification sequence for a sheet using a rotating disk and ball structure according to this invention.

The full sequence of sheet justification is further detailed in FIGS. 6–9. A sheet 54 starts in a spaced apart relation from the raised edge guide 64 in FIG. 6. At this time, the sheet 54 moves along a direction of tangent to the rotation of the disk 42 (arrow 58) relative to the contact point 56 (FIG. 6).

Figure 7:
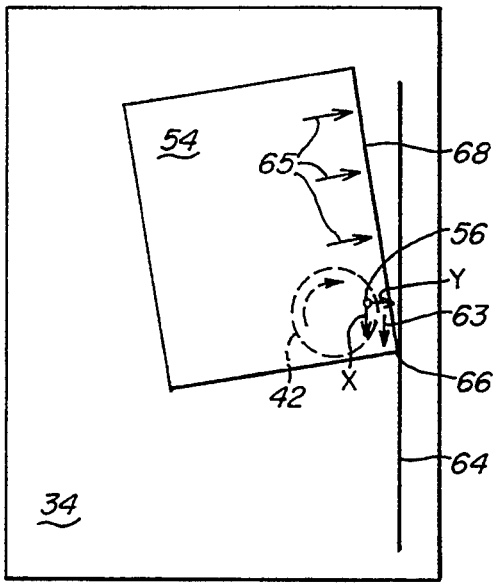
Figure 8:
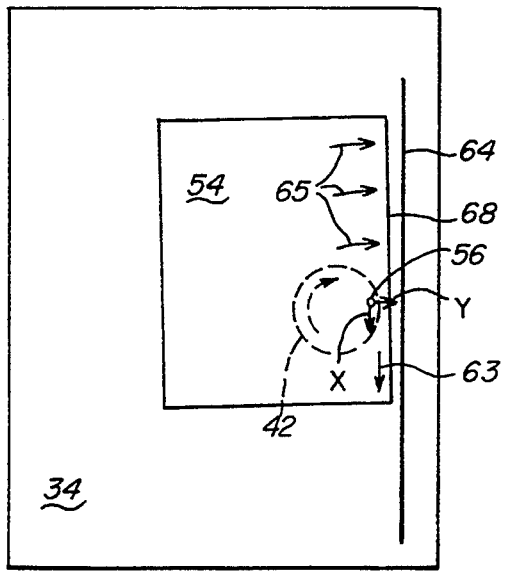
Figure 9:
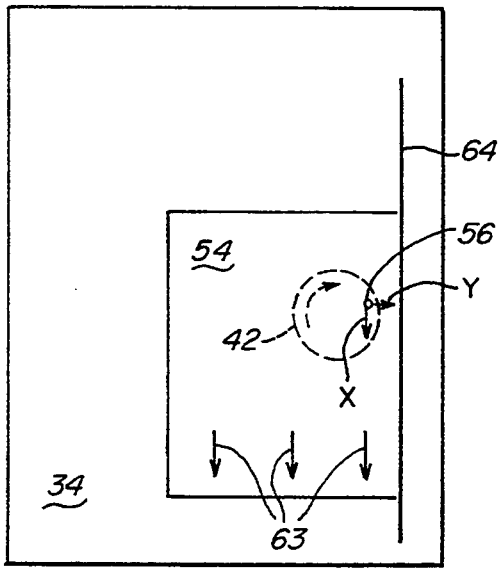

In FIG. 7, the leading corner 66 of the sheet 54 has reached the edge guide 64 and tangential movement is no longer possible, at this time, the perpendicular force vector Y serves to rotate the upstream portion of the sheet side edge 68 toward the raised edge guide 64 as shown by the arrows 65. The movement of the side edges toward the raised edge continues in FIG. 8 until, finally, in FIG. 9 the sheet is brought fully into contact with the raised edge guide without further movement. Only the downstream vector X can act on the sheet at this time since the perpendicular vector Y is forcing the sheet fully against the raised edge guide 64.

The spacing of the raised edge guide 64 from the disk 42 and contact point 56 should be such that the sheet 54 cannot buckle therebetween in spite of the force generated by the perpendicular vector Y. This distance value will vary, therefore, based upon the coefficient friction of the disk surface, the weight of the ball, the general stiffness of the sheet stock utilized and the inward slant of the raised edge guide 64. In other words, for very high friction surface or very thin sheet stock, the spacing between the raised edge guide 64 and the contact point 56 must be fairly close to prevent buckling. Conversely, for thicker sheet stock and/or a lower friction surface, a larger spacing can be tolerated.

In this embodiment, the disk surface includes a polyurethane coating that provides a reasonably good frictional contact with the sheets but that also allow some slippage so that sheets do not tend to buckle at the raised edge. A variety of friction enhancing surface coatings and materials are contemplated.

Referring once again to FIGS. 1–4, the justifier mechanism 40 according to this embodiment includes three rotating disks 42*a–c* aligned along the direction of sheet flow and equally spaced from the raised edge guide 64. Once a sheet is justified against the raised edge guide 64 (usually by the upstream most disk 42*a*), the two more downstream disposed disks 42*b–c* simply maintain it forcibly against the raised edge guide 64 as it is motioned downstream into the utilization device 22. The three disks 42*a–c* in this embodiment are each interlinked by drive belts 70 to a central drive motor M. Thus, all disks 42*a–c* rotate at essentially the same angular velocity.

The sheet justifier 20 according to this invention can be mounted as a free standing portable unit or, as in this embodiment, on brackets 74 that are connected to the utilization device 22. The brackets 74 in this embodiment include adjustment controls 76 for changing the elevation of the upstream funnel 36 relative to access output ports of varying elevations. In this manner, the justifier can accept sheets from a variety of ports on a variety of devices. The port can, in fact, be below the utilization device, on level with the device or above it. The justifier can transfer sheets in any of these orientations.

Figure 10:
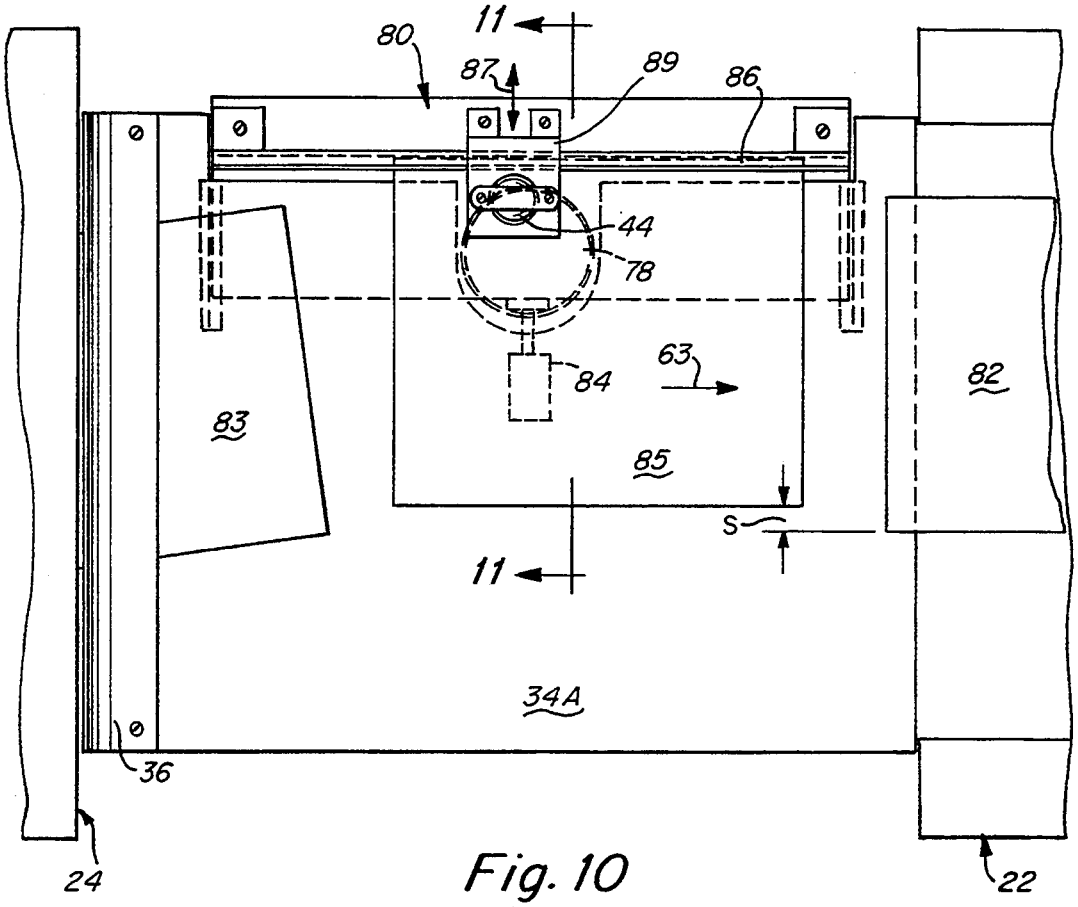
FIG. 10 is an exposed top view of a sheet justifier according to an alternative embodiment of this invention.
Figure 11:
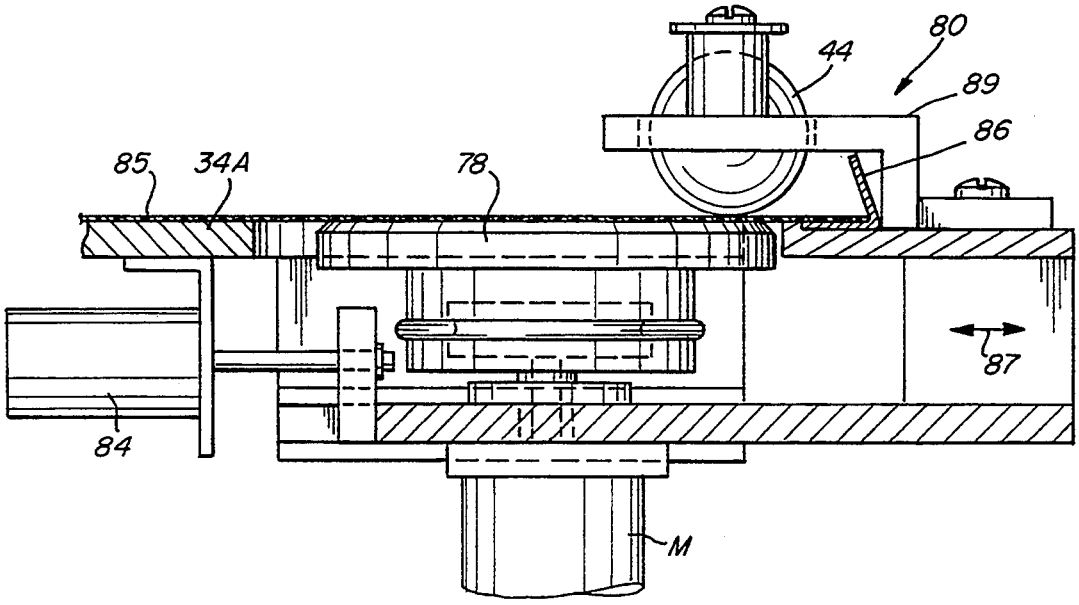
FIG. 11 is a partial cross-sectional rear view of the sheet justifier viewed in an upstream direction taken along line 11—11 of FIG. 10.

FIGS. 10 and 11 detail a sheet justifier according to an alternative embodiment of this invention. As noted above, a plurality of rotating disks can be utilized with any embodiment herein. In this embodiment, only one disk 78 has been employed. This embodiment further includes a moving justifier mechanism 80 to produce jog offset sheets (such as downstream sheet 82) at selected times from input unjustified sheets 83. Sheets are normally aligned and justified as shown by sheet 85. In order to offset justified sheets, the mechanism moves transversely to the direction of sheet flow as shown by the arrow 87 for a distance S. Movement can be accomplished by means of a linear actuator 84 as shown, or by a similar mechanism. In this embodiment, the entire justifier mechanism 80, including the disk 85, its motor M, the ball 44 and framework 89 and edge guide 86, moves relative to the table 34A to produce jog offset sheets. Such movement can be advantageous where the spacing between the raised edge guide 86 and the contact point of the ball 44 must be fairly constant. Alternatively, the edge guide 86 can, itself be movable while the disk 78 and weighted ball 44 remain stationary. As long as the spacing between the ball's contact point on the disk and the position of the edge guide remain, at all times, within an acceptable spacing range to prevent sheet buckling, then jog offset sheets can be produced by moving only the raised edge guide 86.

Figure 12:
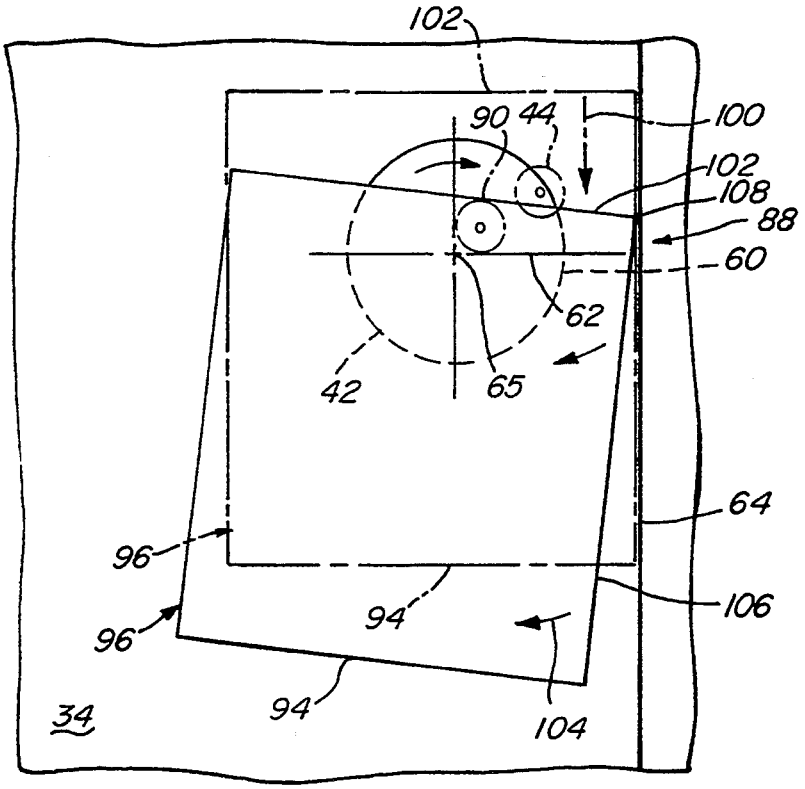
FIGS. 12 and 13 are schematic top views of a sheet justifier according to yet another alternative embodiment of this invention for enabling rotation of sheets.
Figure 13:
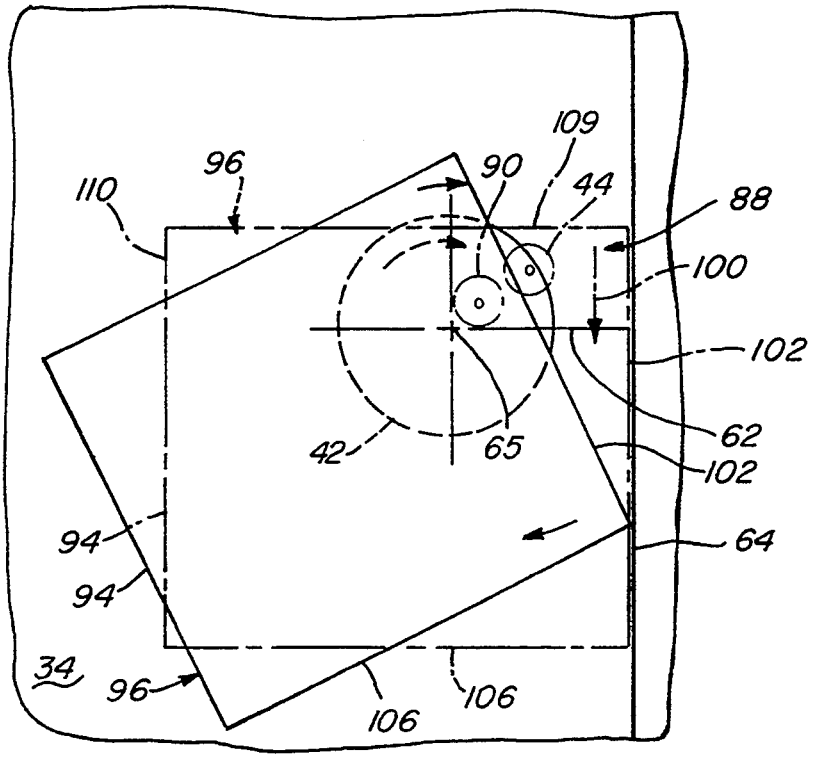

A further improvement according to this invention is depicted in FIGS. 12–13. The sheet justifier mechanism 88 according to this embodiment can be adapted to rotate sheets through 360° and select any sheet edge for justification. The mechanism comprises a disk 42 such as that utilized in the above-described embodiments. There is a first weighted ball 44 positioned proximate the disk outer edge 60 in essentially the same location as that shown in the above-described embodiments (e.g. upstream of the perpendicular diameter line 62). The mechanism 88 according to this embodiment further includes a second weighted ball 90 positioned somewhat closer to the center rotational axis 65 of the disk 42, upstream of the perpendicular diameter line 62, but downstream of the first weighted ball 44. The first more outwardly disposed ball 44 engages the leading edge 94 of the sheet 96 in a manner similar to that of the above-described embodiments. The sheet 96 is justified by the first ball 44 in a relatively normal manner. The sheet 96 is driven as shown by phantom sheet 96 downstream against the edge guide 64 by a downstream vector 100 generated by the first ball 44 until its trailing edge 102 passes out of the first ball's point of contact (solid sheet 96 of FIG. 12). Throughout the driving of the sheet 96, the second more inwardly disposed ball 90 does not substantially affect the driving of the sheet along the raised edge guide 64.

However, once the trailing edge 102 of the sheet passes out of the first ball's contact point, the second ball 90 alone creates a second differently acting set of driving force vectors. The second ball's driving force, owing to its proximity to the rotational axis 65 of the disk 42, is more rotational and less tangential and, hence, causes the downstream part of the sheet's side edge 106 to rotate (arrows 104) about its upstream corner 108 away from contact with the raised edge guide 64. Accordingly, the sheet rotates (solid sheet 96 of FIG. 13) with the second ball 90 so that its (former) trailing edge 102 now engages the raised edge guide 64 as illustrated by the phantom sheet 96 in FIG. 13. The rotated sheet 96 is now brought back into contact with the first more outwardly disposed ball 44. Thus, it is again moved in a downstream direction (arrow 100) along the raised edge guide 64 until the new trailing edge 109 again disengages from the first ball 44. The sheet then again rotates as shown in FIGS. 12 and 13 so that the next edge 110 is brought into contact with the raised edge guide 64. The sheet continues to rotate as long as the second more inwardly disposed ball 90 is in place.

In a practical application, the second ball 90 can include a lifting mechanism, such as a magnet (not shown), that disengages the second ball 90 from contact with the sheet once a desired sheet edge has been brought into contact with the raised edge guide 64. Since the second ball 90 is no longer in contact with the sheet at this time, the sheet is free to travel directly downstream through the justification mechanism into the utilization device without rotating.

Hence, an input sheet can be rotated at selected times by dropping the second more inwardly disposed ball 90 while the sheet is being driven through the mechanism 88. The sheet then rotates through the desired number of edges, until the proper rotation has been achieved. At this time, the ball 90 can be lifted from contacts with the sheet to allow the sheet to pass on into the next device with the desired rotational orientation.

The foregoing has been a detailed description of some possible embodiments of the invention. Various modifications and equivalents are contemplated without departing from the spirit and scope of this invention. For example, while square and rectangular sheets are illustrated herein, justification of non-rectangular, polygonal, sheets is contemplated. The justifier according to this invention requires only a relatively straight sheet edge to engage the raised edge guide. Accordingly, this description is meant to be taken only by way of example and not to otherwise limit the scope of the invention.

What is claimed is:

1. A method for justifying sheets comprising:

transferring sheets along a supporting surface to a first rotating surface positioned proximate a raised edge guide that is aligned to guide edges of sheets along a line in a downstream direction, providing a first freely rotating mass positioned over the first rotating surface and contacting the first rotating surface at a position remote from an axis of rotation of the first rotating surface;

engaging each of the sheets between the first rotating surface and the first freely rotating mass wherein the first freely rotating mass resolves rotation of the first rotating surface, at a contact point between the first freely rotating mass and the first rotating surface, into a first driving force that biases each of the sheets against the raised edge guide and a second driving force directed in the downstream direction that drives each of the sheets along the raised edge guide in the downstream direction;

transferring each of the sheets along the supporting surface from the first rotating surface to a second rotating surface positioned proximate the raised edge guide, providing a second freely rotating mass positioned over the second rotating surface and contacting the second rotating surface at a position remote from an axis of rotation of the second rotating surface;

engaging each of the sheets between the second rotating surface and the second freely rotating mass wherein the second freely rotating mass resolves rotation of the second rotating surface, at a contact point between the second freely rotating mass and the second rotating surface, into a third driving force that biases each of the sheets against the raised edge guide and a fourth driving force directed in the downstream direction that drives each of the sheets along the raised edge guide in a downstream direction; and discharging each of the sheets from a downstream end of the supporting surface against the raised edge guide in a justified orientation.

2. A method as set forth in claim 1 further comprising moving the guide edge so as to offset sheets moving therealong.

3. A method as set forth in claim 1 further comprising providing a selectively-engagable third freely rotating mass located approximately between one of, respectively, the contact point of the first freely rotating mass and the axis of rotation of the first rotating surface and the contact point of the second freely rotating mass and the axis of rotation of the second rotating surface at selected times so as to rotate sheet relative to the raised edge guide.

4. A method as set forth in claim 1 further comprising attaching an end of the supporting surface to a utilization device so that the supporting surface is interconnected with the utilization device.

5. A method as set forth in claim 4 wherein the step of attaching further comprises locating an attachment member at a downstream end of the supporting surface so that the downstream end delivers justified sheets to the utilization device.

6. A method as set forth in claim 4 wherein the step of attaching further comprises adjusting an angle of the supporting surface relative to the utilization device so that an end of the supporting surface opposite the downstream end is locatable at variable elevations.

7. A method as set forth in claim 6 further comprising providing a funnel structure to the end of the supporting surface opposite the downstream end, the funnel structure including an edge that overlies the supporting surface and that tapers toward the supporting surface in the downstream direction to direct sheets moving in the downstream direction toward the supporting surface and into the first rotating surface.

8. A sheet justifier comprising:

a supporting surface having an upstream end and a downstream end;

a raised edge guide extending along the supporting surface aligned substantially from the upstream end to the downstream end;

a first rotating surface having a first axis of rotation and a first freely rotating mass positioned thereover and contacting the first rotating surface at a point remote from the axis of rotation;

a second rotating surface positioned downstream of the first rotating surface and positioned proximate the raised edge guide and having a second axis of rotation and a second freely rotating mass contacting the second rotating surface at a point remote from the second axis of rotation; and the first freely rotating mass and the second freely rotating mass being located relative to each of the first rotating surface and the second rotating surface, respectively, so that a sheet is driven by each of the first rotating surface and the second rotating surface by resolved components of force with an edge of the sheet maintained against the raised edge guide and moving in a downstream direction along the edge guide, the sheet moves from the upstream end into engagement with the first rotating surface and from the first rotating surface into engagement with the second rotating surface and from the second rotating surface to the downstream end of the supporting surface along the edge guide in a justified orientation.

9. A sheet justifier as set forth in claim 8 wherein the raised edge guide is movable to offset a selected sheet in a direction transverse to the downstream direction as the selected sheet is driven along the edge guide.

10. A sheet justifier as set forth in claim 8 further comprising a third freely rotating mass positioned over one of the first rotating surface and the second rotating surface constructed and arranged to enable selective rotation of a sheet on the supporting surface when the sheet is in engagement with the third freely rotating mass.

11. A sheet justifier as set forth in claim 8 further comprising a support bracket attached to the downstream end of the supporting surface, the support bracket being interconnected with a utilization device.

12. A sheet justifier as set forth in claim 11 wherein the support bracket includes an adjustment mechanism that enables rotation of the supporting surface relative to the bracket to vary an elevation of the upstream end of the supporting surface.

13. A sheet justifier as set forth in claim 8 further comprising a funnel structure having a tapered edge that guides sheets onto the upstream end of the supporting surface.

* * * * *